US008862005B2

(12) United States Patent
Abe et al.

(10) Patent No.: US 8,862,005 B2
(45) Date of Patent: Oct. 14, 2014

(54) IMAGE FORMING APPARATUS

(71) Applicant: Fuji Xerox Co., Ltd., Tokyo (JP)

(72) Inventors: Jun Abe, Kanagawa (JP); Shota Oba, Kanagawa (JP); Tomio Onuki, Kanagawa (JP); Sakae Yoshioka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 48 days.

(21) Appl. No.: 13/749,907

(22) Filed: Jan. 25, 2013

(65) Prior Publication Data

US 2014/0056603 A1 Feb. 27, 2014

(30) Foreign Application Priority Data

Aug. 24, 2012 (JP) ..... 2012-185038

(51) Int. Cl.
*G03G 15/08* (2006.01)

(52) U.S. Cl.
CPC ..... *G03G 15/0825* (2013.01); *G03G 15/0896* (2013.01); *G03G 15/0806* (2013.01); *G03G 15/0851* (2013.01); *G03G 15/0891* (2013.01)
USPC ..... 399/55

(58) Field of Classification Search
USPC ..... 399/55, 62, 285
See application file for complete search history.

(56) References Cited

U.S. PATENT DOCUMENTS 5,030,996 A * 7/1991 Tajima et al. ..... 399/232
2010/0008692 A1* 1/2010 Kim et al. ..... 399/88
2011/0299893 A1* 12/2011 Takai et al. ..... 399/285

FOREIGN PATENT DOCUMENTS

JP 2000-098730 A 4/2000

* cited by examiner

*Primary Examiner* — Gregory H Curran
(74) *Attorney, Agent, or Firm* — Sughrue Mion, PLLC

(57) ABSTRACT

An image forming apparatus includes a latent image carrier, a container that contains a developer including a toner, developer transport members disposed so that peripheral surfaces thereof face the latent image carrier, a power supply that supplies voltages to the developer transport members, a detector that detects a toner concentration of the developer, and a controller. The controller performs control so that the power supply supplies to the developer transport members, when the toner concentration detected by the detector is higher than a predetermined upper limit, voltages having waveforms that generating a potential difference therebetween that causes the toner concentration of the developer distributed to a most downstream developer transport member to decrease and the toner concentration of the developer distributed to at least one of the developer transport members that is disposed upstream of the most downstream developer transport member to increase.

6 Claims, 9 Drawing Sheets

IMAGE FORMING APPARATUS

CROSS-REFERENCE TO RELATED APPLICATIONS

This application is based on and claims priority under 35 USC 119 from Japanese Patent Application No. 2012-185038 filed Aug. 24, 2012.

BACKGROUND

Technical Field

The present invention relates to an image forming apparatus.

SUMMARY

According to an aspect of the invention, an image forming apparatus includes a latent image carrier that rotates and that has a surface on which an electrostatic latent image to be developed by a charged toner is formed; a container that contains a developer including the toner; plural developer transport members disposed side by side so that peripheral surfaces thereof face the latent image carrier and so that the peripheral surfaces of adjacent ones thereof face each other, the developer transport members distributing the developer supplied from the container among one another and transporting the developer to the surface of the latent image carrier by carrying the developer on the peripheral surfaces and rotating in circumferential directions of the peripheral surfaces; a power supply that supplies voltages having plural waveforms having an identical period to the plural developer transport members; a detector that detects a toner concentration of the developer contained in the container; and a controller. The controller performs control so that the power supply supplies to the plural developer transport members, when the toner concentration detected by the detector is higher than a predetermined upper limit, voltages having the waveforms that generate a potential difference therebetween, the potential difference causing the toner concentration of the developer distributed to a most downstream developer transport member to decrease and the toner concentration of the developer distributed to at least one of the developer transport members that is disposed upstream of the most downstream developer transport member to increase, the most downstream developer transport member being one of the developer transport members that is disposed at a most downstream position in a movement direction in which a region on the surface of the latent image carrier facing the plural developer transport members moves.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

First Exemplary Embodiment

Figure 1:
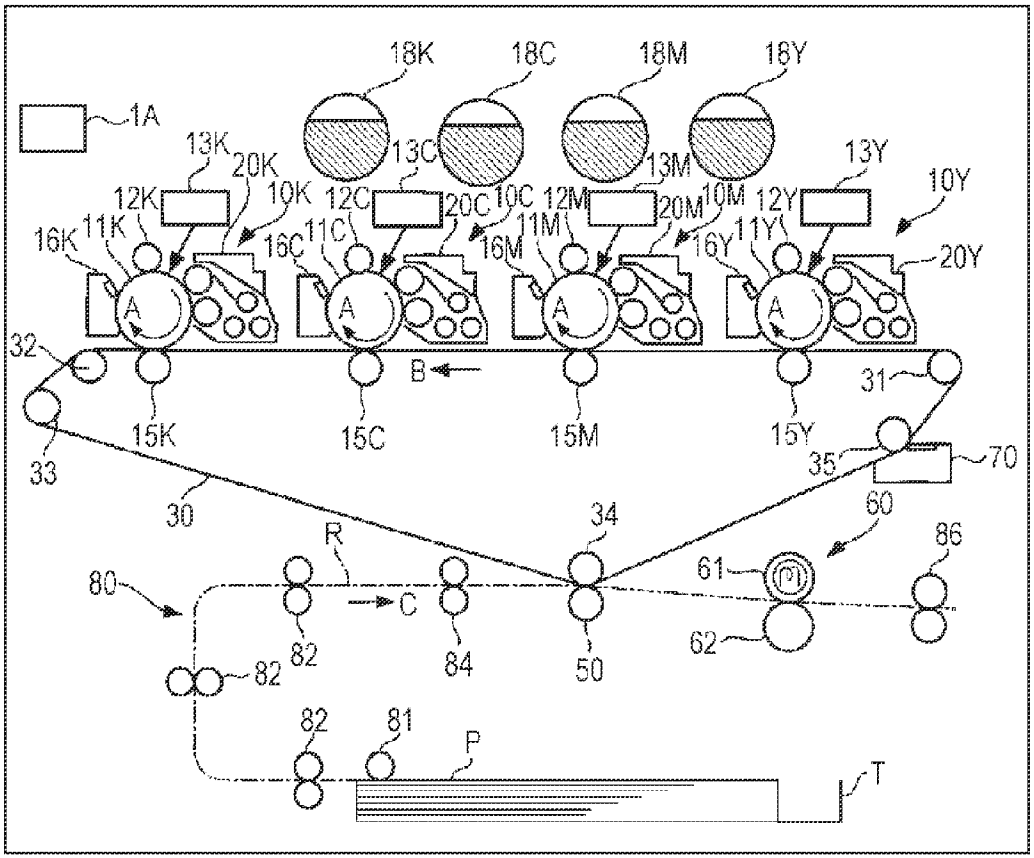
FIG. 1 is a schematic view of an image forming apparatus according to a first exemplary embodiment of the present invention.

FIG. 1 is a schematic view of an image forming apparatus according to a first exemplary embodiment of the present invention.

An image forming apparatus 1 illustrated in FIG. 1 is a tandem-type color printer in which image forming units 10Y, 10M, 10C, and 10K for yellow (Y), magenta (M), cyan (C), and black (K) are parallelly arranged. The image forming apparatus 1 is capable of printing a single-color image and a full-color image composed of four color toner images. Toner cartridges 18Y, 18M, 18C, and 18K contain yellow, magenta, cyan, and black toners.

Because the four image forming units 10Y, 10M, 10C, and 10K have substantially the same structure, the image forming unit 10Y for yellow will used as an example. The image forming unit 10Y includes a photoconductor drum 11Y, a charger 12Y, an exposure unit 13Y, a developing device 20Y, a first transfer unit 15Y, and a photoconductor cleaner 16Y.

The photoconductor drum 11Y includes a cylindrical body and a photoconductor layer disposed on a surface of the cylindrical body. The photoconductor drum 11Y holds an image on a surface thereof and rotates around an axis in the direction of arrow A. The charger 12Y, the exposure unit 13Y, the developing device 20Y, the first transfer unit 15Y, and the photoconductor cleaner 16Y are disposed so as to surround the photoconductor drum 11Y in the direction of arrow A.

The charger 12Y charges the surface of the photoconductor drum 11Y. The charger 12Y is a charging roller that contacts the surface of the photoconductor drum 11Y. A voltage having a polarity the same as the polarity of a toner used in the developing device 20Y is applied to the charger 12Y. The charger 12Y charges the surface of the photoconductor drum 11Y that is in contact with the charger 12Y. The exposure unit 13Y performs exposure by irradiating the surface of the photoconductor drum 11Y with light. The exposure unit 13Y emits a laser beam in accordance with an image signal supplied to the image forming apparatus 1 from the outside, and scans the photoconductor drum 11Y with the laser beam. The developing device 20Y develops the surface of the photoconductor drum 11Y by using a developer. The toner cartridge 18Y supplies a toner to the developing device 20Y. The developing device 20Y agitates the developer, in which the toner and a magnetic carrier are mixed together, and thereby charges the toner and the magnetic carrier, and develops the surface of the photoconductor drum 11Y using the charged toner. The first transfer unit 15Y is a roller that faces the photoconductor drum 11Y with an intermediate transfer belt 30 therebetween. The first transfer unit 15Y, to which a voltage relative to the photoconductor drum 11Y is applied, transfers a toner image on the photoconductor drum 11Y to the intermediate transfer belt 30. The photoconductor cleaner 16Y cleans the surface of the photoconductor drum 11Y by removing waste substances such as toner that remains on a part of the surface of the photoconductor drum 11Y on which the first transfer unit 15Y has performed a transfer operation.

The image forming apparatus 1 further includes the intermediate transfer belt 30, a fixing unit 60, a sheet transport unit 80, and a controller 1A. The intermediate transfer belt 30 is an endless belt that is looped over belt support rollers 31 to 35. The intermediate transfer belt 30 rotates in the direction of arrow B and moves past the image forming units 10Y, 10M, 10C, 10K, and a second transfer unit 50. Color toner images are transferred to the intermediate transfer belt 30 from the image forming units 10Y, 10M, 10C, and 10K. The intermediate transfer belt 30 moves while carrying the color toner images thereon.

The second transfer unit 50 is a roller that rotates with the intermediate transfer belt 30 and a sheet P interposed between the second transfer unit 50 and a backup roller 34, which is one of the belt support rollers 31 to 35. The second transfer unit 50, to which a voltage having a polarity opposite to that of the toner is applied, transfers a toner image from the intermediate transfer belt 30 to the sheet P.

The fixing unit 60 fixes a toner image to the sheet P. The fixing unit 60 includes a pressing roller 62 and a heating roller 61, in which a heater is disposed. The heating roller 61 and the pressing roller 62 heat and press the toner of an unfixed toner image formed on the sheet P by pressing the sheet P while the sheet P passes through a gap therebetween, and thereby fix the toner image to the sheet P.

The sheet transport unit 80 transfers the sheet P along a sheet transport path R, which extends through the second transfer unit 50 and the fixing unit 60. The sheet transport unit 80 includes a pick-up roller 81, transport rollers 82, registration rollers 84, and output rollers 86. The pick-up roller 81 picks up the sheet P contained in the sheet container T, and the transport rollers 82 transport the sheet P. The registration rollers 84 transport the sheet P to the second transfer unit 50, and the output rollers 86 output the sheet P to the outside.

The basic operation of the image forming apparatus 1 illustrated in FIG. 1 will be described. In the image forming unit 10Y for yellow, the photoconductor drum 11Y rotates in the direction of arrow A, and the charger 12Y charges the surface of the photoconductor drum 11Y. The exposure unit 13Y irradiates the photoconductor drum 11Y with light in accordance with data for yellow included in an image signal. The exposure unit 13Y forms an electrostatic latent image on the surface of the photoconductor drum 11Y by irradiating the surface of the photoconductor drum 11Y with light based on an image signal for yellow included in the image signal supplied from the outside. The toner cartridge 18Y supplies yellow toner to the developing device 20Y. The developing device 20Y forms a toner image by developing the electrostatic latent image on the photoconductor drum 11Y using the toner. The photoconductor drum 11Y rotates while holding the yellow toner image formed thereon. The first transfer unit 15Y transfers the toner image formed on the surface of the photoconductor drum 11Y to the intermediate transfer belt 30. After transfer has been finished, the photoconductor cleaner 16Y removes toner remaining on the photoconductor drum 11Y.

The intermediate transfer belt 30 rotates in the direction of arrow B. The image forming units 10M, 10C, and 10K for colors other than yellow form toner images of the other colors in the same way as the image forming unit 10Y does, and transfers the toner images to the intermediate transfer belt 30 so as to overlap each other.

The pick-up roller 81 picks up the sheet P from the sheet container T. The transport rollers 82 and the registration rollers 84 transport the sheet P along the sheet transport path R in the direction of arrow C toward the second transfer unit 50. The registration rollers 84 transport the sheet P to the second transfer unit 50 on the basis of the timings at which the toner images are transferred to the intermediate transfer belt 30. The second transfer unit 50 transfers the toner images from the intermediate transfer belt 30 to the sheet P. The sheet P, on which the toner images have been transferred, is transported from the second transfer unit 50 to the fixing unit 60, and the transferred toner images are fixed to the sheet P. Thus, an image is formed on the sheet P. The output rollers 86 output the sheet P, on which an image has been formed, to the outside of the image forming apparatus 1. A belt cleaner 70 removes toner remaining on the intermediate transfer belt 30 after the second transfer unit 50 has performed a transfer operation.

Developing Device

Figure 2:
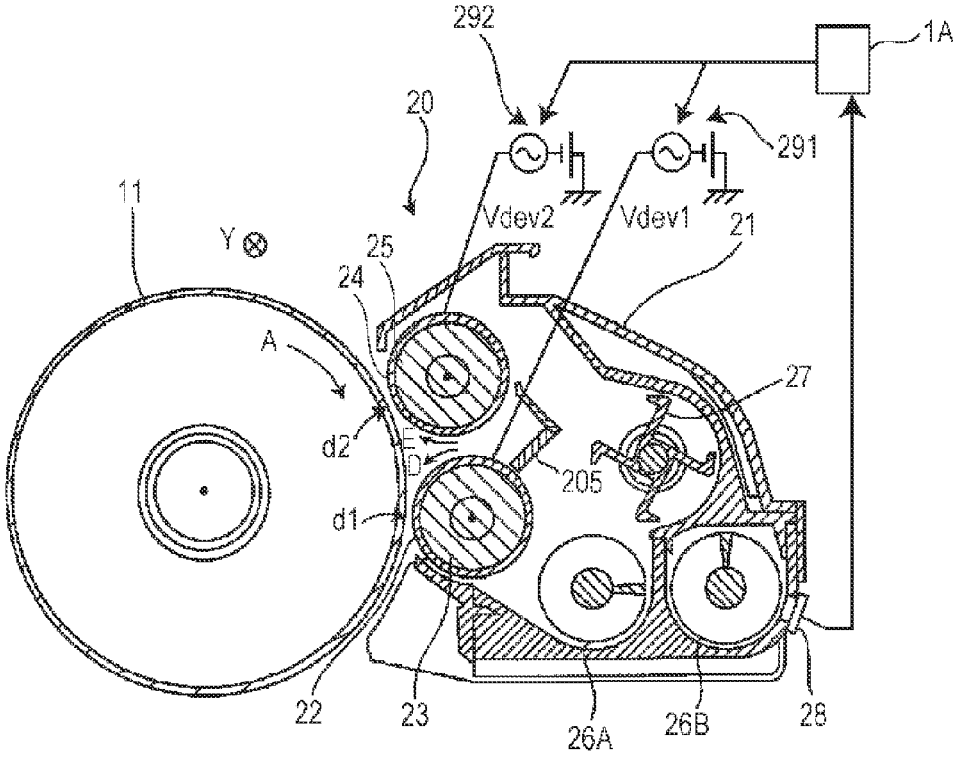
FIG. 2 is a sectional view of a developing device illustrated in FIG. 1.

FIG. 2 is a sectional view of the developing device illustrated in FIG. 1. Power supplies 291 and 292 illustrated in FIG. 2 supply development bias voltages to the developing device 20. The developing devices 20Y to 20K for respective colors illustrated in FIG. 1, which have the same structure, will be collectively described as the developing device 20.

The developing device 20 includes a container 21, a downstream roller 22, a first magnet 23, an upstream roller 24, a second magnet 25, a first agitation member 26A, a second agitation member 26B, a paddle member 27, and a toner concentration sensor 28. Here, the downstream roller 22 and the upstream roller 24 are respectively examples of a most downstream developer transport member and a most upstream developer transport member. The toner concentration sensor 28 is an example of a detector.

The container 21 contains a developer and supports the members of the developing device 20. The downstream roller 22 and the upstream roller 24, which are cylindrical development rollers extending in the axial direction Y, are disposed in the container 21 so that the peripheral surfaces thereof face the photoconductor drum 11. The downstream roller 22 and the upstream roller 24 are disposed so that there is a gap between each of these rollers 22 and 24 and the photoconductor drum 11.

The downstream roller 22 is disposed downstream of the upstream roller 24 in a direction in which a peripheral surface of the photoconductor drum 11, which rotates in the direction of arrow A, moves. The first magnet 23, which is disposed in the downstream roller 22, attracts the developer toward the downstream roller 22. The second magnet 25, which is disposed in the upstream roller 24, attracts the developer toward the upstream roller 24. The first magnet 23 has plural magnetic poles arranged in the circumferential direction of the downstream roller 22. The second magnet 25 has plural magnetic poles arranged in the circumferential direction of the upstream roller 24.

Each of the downstream roller 22 and the upstream roller 24 rotates and thereby transports the developer in the container 21 to a surface of the photoconductor drum 11. In the present exemplary embodiment, the downstream roller 22 rotates in the direction of arrow D, and the upstream roller 24 rotates in the direction of arrow E, which is opposite to the direction of arrow D. That is, the downstream roller 22 and the upstream roller 24 rotate so that parts of the peripheral surfaces thereof that face each other move in substantially the same direction. A part of the peripheral surface of the downstream roller 22 that faces a part the photoconductor drum 11 in a first development region d1 moves in a direction substantially the same as that of the part of the peripheral surface of the photoconductor drum 11 ("with"). A part of the peripheral surface of the upstream roller 24 that faces a part of the photoconductor drum 11 in a second development region d2 moves in a direction opposite to that of the part of the peripheral surface of the photoconductor drum 11 ("against").

The first agitation member 26A and the second agitation member 26B agitate the developer in the container 21. Each of the first agitation member 26A and the second agitation member 26B has spiral blades disposed around a rotary shaft extending in the axial direction Y. The first agitation member 26A and the second agitation member 26B are disposed adjacent to each other, and the first agitation member 26A is disposed adjacent to the downstream roller 22. The first agitation member 26A and the second agitation member 26B rotate and thereby transport the developer in opposite directions along the axial direction Y. The developer circulates in the container 21 while being agitated by the first agitation member 26A and the second agitation member 26B. While being agitated, toner and magnetic carrier of the developer are charged with opposite polarities. The toner is negatively charged, and the magnetic carrier is positively charged. The toner concentration sensor 28 detects the toner concentration of the developer by detecting the magnetism of the magnetic carrier in the container 21.

The developer transported by the first agitation member 26A is attracted to the downstream roller 22, is supported on the downstream roller 22, and moves in the direction of arrow D. A layer regulation member 205, which has a plate-like shape, is disposed near a part of the peripheral surface of the downstream roller 22 between the first agitation member 26A and the upstream roller 24. The layer regulation member 205 regulates the thickness, that is, the amount of the developer transported on the downstream roller 22. Then, a part of the developer is distributed to the upstream roller 24 in a region in which the downstream roller 22 and the upstream roller 24 face each other. The upstream roller 24 transports the developer distributed thereto to a second development region d2 of the photoconductor drum 11. The downstream roller 22 transports the developer that remains on the downstream roller 22 to a first development region d1 of the photoconductor drum 11.

In a region in which the downstream roller 22 and the upstream roller 24 distribute the developer between each other, the developer is distributed on the basis of the magnetic forces of the first magnet 23 and the second magnet 25 and the electric potentials of the downstream roller 22 and the upstream roller 24. Because the toner of the developer is negatively charged, if the potential difference (voltage) between the downstream roller 22 and the upstream roller 24 is greater than a movement threshold voltage, the toner tends to move toward one of the downstream and upstream rollers 22 and 24 having a higher potential (positive side). The greater the potential difference, the larger the amount of toner that moves. The toner concentration of the developer distributed to the downstream roller 22 and the upstream roller 24 are controlled by the voltages supplied by the power supplies 291 and 292. The controller 1A controls the voltage of DC component (mean value), the amplitude of AC component, and the phase of waveform of each of the voltages output from the power supplies 291 and 292.

The photoconductor drum 11 contacts the developer in the second development region d2 and the first development region d1. The toner of the developer adheres to an electrostatic latent image on the photoconductor drum 11A, and thereby a toner image is formed. The developer that has not adhered to the photoconductor drum 11 in the first development region d1 is transported by the downstream roller 22 and is returned to the first agitation member 26A. The developer that has not adhered to the photoconductor drum 11 in the second development region d2 is transported by the upstream roller 24 and is returned to the first agitation member 26A.

According to the present exemplary embodiment, the peripheral surface of the upstream roller 24 moves in a direction opposite to that of the photoconductor drum 11. Therefore, the upstream roller 24 has development ability that is higher than that of the downstream roller 22, whose peripheral surface moves in a direction the same as that of the peripheral surface of the photoconductor drum 11. That is, if conditions other than the rotation direction (for example, the electric potential) are the same, the upstream roller 24 causes a larger amount of toner to adhere to the photoconductor drum 11 than the downstream roller 22 does. However, the upstream roller 24 is more likely to cause toner fog, which is a phenomenon in which the toner adheres to a background region (non-image region) in which an electrostatic latent image has not been formed. In contrast, the downstream roller 22 is less likely to cause toner fog, although the development ability of the downstream roller 22 is lower than that of the upstream roller 24. The downstream roller 22 is capable of preventing toner fog by attracting toner that the upstream roller 24 has caused to adhere to a background region.

With the developing device 20 according to the present exemplary embodiment, the upstream roller 24, which moves in a direction opposite to that of the photoconductor drum 11, causes a large amount of toner to adhere to the photoconductor drum 11, and the downstream roller 22, which moves in a direction the same as that of the photoconductor drum 11, prevents toner fog while compensating for shortage of toner in an image.

With the image forming apparatus 1 according to the present exemplary embodiment, the controller 1A controls the voltages supplied by the power supplies 291 and 292 and thereby controls the amount of toner of the developer distributed by the downstream roller 22 and the upstream roller 24.

Figure 3:
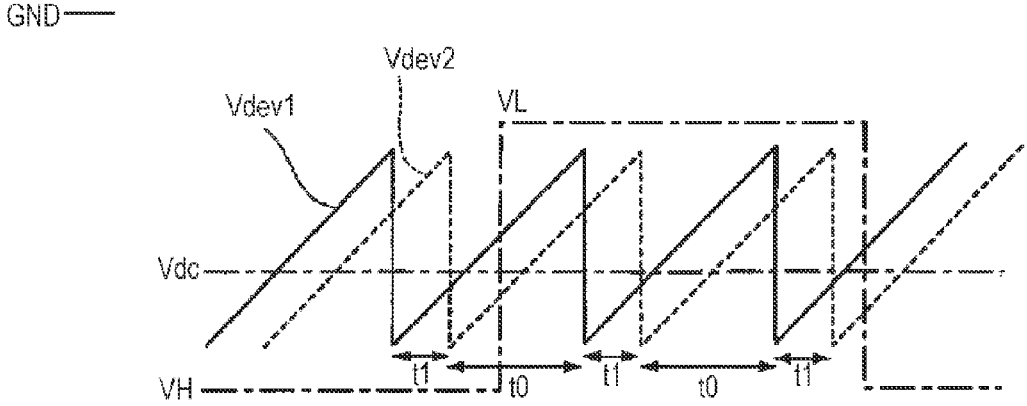
FIG. 3 is a diagram illustrating the waveforms of voltages supplied by power supplies.

FIG. 3 is a diagram illustrating the waveforms of voltages supplied by the power supplies.

FIG. 3 illustrates the waveform of a voltage Vdev1 supplied from the power supply 291 to the downstream roller 22 and the waveform of a voltage Vdev2 supplied from the power supply 292 to the upstream roller 24. FIG. 3 also illustrates the electric potentials of the peripheral surfaces of the photoconductor drums 11 (11Y to 11K).

As illustrated in FIG. 2, each of the two power supplies 291 and 292 outputs a voltage in which an AC voltage is superimposed on a DC voltage. The DC voltage Vdc of the two power supplies 291 and 292 is a voltage between a charge potential VH, which is the potential of the peripheral surface of the photoconductor drum 11 (one of 11Y to 11K) that have been charged by the charger 12 (one of 12Y to 12K), and an exposure potential VL, which is the potential of the peripheral surface of the photoconductor drum 11 that has been exposed to light by the exposure unit 13 (one of 13Y to 13K).

The waveforms of the two voltages Vdev1 and Vdev2 for one period are the same. The waveform for one period is asymmetric with respect to time. To be specific, the waveform is a sawtooth wave. The waveforms of the AC components of the two voltages Vdev1 and Vdev2 are also the same.

The waveforms of the two voltages Vdev1 and Vdev2 are the same waveforms whose phases are displaced from each other. As a result of the phase displacement, there are periods t1 in which the voltage Vdev2 of the upstream roller 24 is higher than (has a negative value whose absolute value is smaller than) the voltage Vdev1 of the downstream roller 22.

In the periods t1, the amount of toner that moves to the upstream roller 24 increases in a region in which the upstream roller 24 and the downstream roller 22 face each other.

In periods t0, which are the periods excluding the periods t1, the voltage Vdev1 of the downstream roller 22 is higher than the voltage Vdev2 of the upstream roller 24. However, the (absolute value of the) voltage difference in the periods t0 is smaller than that in the periods t1. There is a nonlinear relationship between the voltage difference and the amount of toner that moves, and the voltage difference in the periods t0 only negligibly influences the movement of toner.

In contrast, the difference between the voltages Vdev1 and Vdev2 in the periods t1 influences the movement of toner. As a result, because the voltages Vdev1 and Vdev2 illustrated in FIG. 3 are supplied to the downstream roller 22 and the upstream roller 24, the toner concentration of the developer distributed to the upstream roller 24 becomes higher than that of the developer distributed to the downstream roller 22.

Since the waveforms of the two voltages Vdev1 and Vdev2 illustrated in FIG. 3 are the same waveforms whose phases are displaced from each other, the DC voltages Vdc (included in Vdev1 and Vdev2) are substantially same.

In contrast, for example, if the two voltages Vdev1 and Vdev2 have the same phase, the toner concentration of the developer distributed to the upstream roller 24 becomes substantially the same as that of the developer distributed to the downstream roller 22.

When the toner concentration of the developer distributed to the upstream roller 24 and the toner concentration of the developer distributed to the downstream roller 22 change, the waveform and amplitude of the alternative current and the DC voltage Vdc do not change. Therefore, the toner concentrations of the developer distributed to the downstream roller 22 and upstream roller 24 are controlled while maintaining the voltages of the downstream roller 22 and upstream roller 24 relative to the photoconductor drum 11.

The controller 1A controls the relative phases of the waveforms of the voltages supplied by the power supplies 291 and 292, and thereby controls the toner concentrations of the developer distributed to the downstream roller 22 and upstream roller 24.

Figure 4:
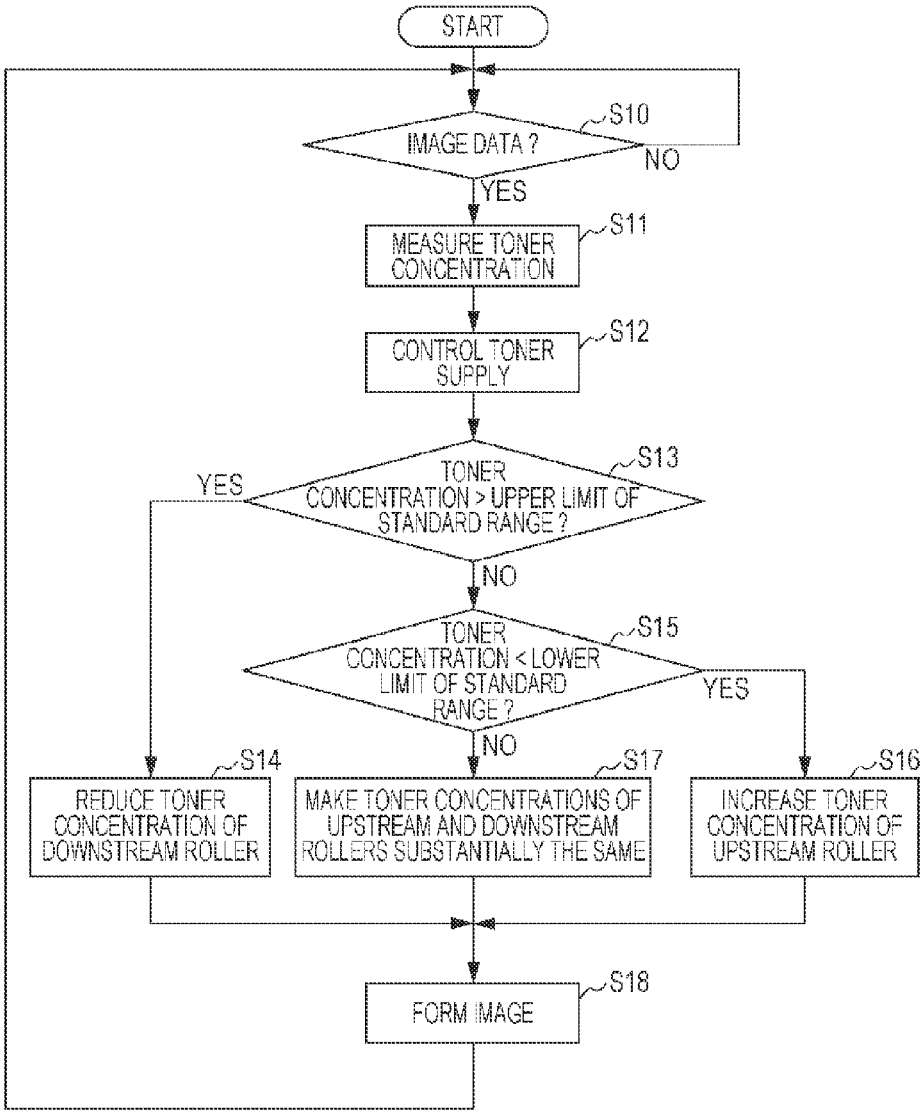
FIG. 4 is a flowchart of an operation of the image forming apparatus illustrated in FIG. 1.

FIG. 4 is a flowchart of an operation of the image forming apparatus illustrated in FIG. 1.

The controller 1A controls the components of the image forming apparatus 1. When image data is supplied from the outside of the image forming apparatus 1 ("Yes" in step S10), the controller 1A causes the toner concentration sensor 28 to measure the toner concentration (step S11). The controller 1A controls the amount of toner supplied to the developing device 20 in accordance with the measured toner concentration. To be specific, as the toner concentration increases, the controller 1A decreases the amount of toner supplied from the toner cartridges 18Y to 18K. As the toner concentration decreases, the controller 1A increases the amount of toner supplied from the toner cartridges 18Y to 18K. However, there is a time lag between when the amount of toner supplied from the toner cartridges 18Y to 18K is changed to when the toner concentration in the containers 21 changes.

If the measured toner concentration is higher than the upper limit of a predetermined standard range ("Yes" in step S13), the controller 1A determines that toner fog is likely to occur. In this case, the controller 1A controls distribution of the developer to the downstream roller 22 and the upstream roller 24 so that the toner concentration of the developer distributed to the downstream roller 22 is decreased (step S14), and performs an image forming operation (step S18). Here, the standard range is a range of toner concentration with which a thin spot and toner fog are not visually recognized in an image that is developed when the developer having substantially the same toner concentrations in this range is distributed to the downstream roller 22 and the upstream roller 24.

In step S14, the controller 1A causes the power supplies 291 and 292 to supply, to the downstream roller 22 and the upstream roller 24, voltages having waveforms with which the toner concentration of the developer distributed to the downstream roller 22 is decreased and the toner concentration of the developer distributed to the upstream roller 24 is increased. To be specific, the power supply 291 supplies the voltage Vdev1 illustrated in FIG. 3 to the downstream roller 22. The power supply 292 supplies the voltage Vdev2 illustrated in FIG. 3 to the upstream roller 24. The voltages Vdev1 and Vdev2 illustrated in FIG. 3 have the periods t1, in which there is a potential difference that influences movement of toner from the upstream roller 24 to the downstream roller 22. Therefore, the toner concentration of the developer distributed to the downstream roller 22 becomes lower than that of the developer in the container 21, and the toner concentration of the developer distributed to the upstream roller 24 becomes higher than that of the developer in the container 21. When development is performed in this state, even if toner fog occurs in an image formed on the photoconductor drum 11 by being developed by the upstream roller 24, the toner causing the toner fog is absorbed by the downstream roller 22, which subsequently passes.

If it is determined in step S13 that the toner concentration is lower than or equal to the upper limit of the predetermined standard range ("No" in step S13), the controller 1A compares the measured toner concentration with the lower limit of the standard range (step S15). If the measured toner concentration is lower than the lower limit of the predetermined standard range ("Yes" in step S15), the controller 1A determines that a thin spot or a thin region is likely to be generated. In this case, the controller 1A controls distribution of the developer to the downstream roller 22 and the upstream roller 24 so that the toner concentration of the developer distributed to the upstream roller 24 is increased (step S16), and performs an image forming operation (step S18). The operation performed in step S16 is similar to that of step S14 described above. As a result of the operation in step S16, the toner concentration of the developer distributed to the downstream roller 22 becomes lower than that of the developer in the container 21, and the toner concentration of the developer distributed to the upstream roller 24 becomes higher than that of the developer in the container 21. When development is performed in this state, developer whose toner concentration is higher than that of toner in the container 21 is supplied to the upstream roller 24, which has a higher development ability than the downstream roller 22, so that generation of a thin spot and decrease in the density of an image are reduced.

If it is determined in step S15 that the measured toner concentration is higher than or equal to the lower limit of the predetermined standard range ("No" in step S15), the toner concentration is in the standard range. In this case, the controller 1A makes the toner concentrations of the developer distributed to the downstream roller 22 and the upstream roller 24 be substantially the same (step S17), and performs an image forming operation (step S18). To be specific, the controller 1A causes the power supplies 291 and 292 to supply voltages having waveforms whose phases are the same as each other. In this case, between the voltages supplied to the downstream roller 22 and the upstream roller 24, there is no difference that influences the movement of toner. Therefore, the toner concentrations of the developer distributed to the downstream roller 22 and the upstream roller 24 are substantially the same.

Second Exemplary Embodiment

Next, a second exemplary embodiment of the present invention will be described. In the second exemplary embodiment, the voltages supplied to the downstream roller 22 and the upstream roller 24 so as to change the toner concentrations of the developer distributed to these rollers have rectangular waveforms, instead of the sawtooth waveforms of the first exemplary embodiment. The elements the same as those of the exemplary embodiment described above will be denoted by the same numerals, and the difference between the first and second exemplary embodiments will be described.

Figure 5:
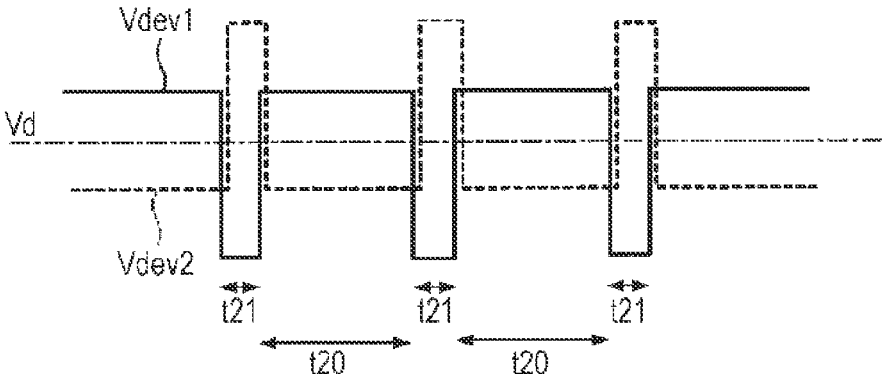
FIG. 5 is a diagram illustrating the waveforms of voltages supplied to a downstream roller and an upstream roller according to a second exemplary embodiment.

FIG. 5 is a diagram illustrating the waveforms of voltages supplied to a downstream roller and an upstream roller according to the second exemplary embodiment.

The waveform of the voltage Vdev1 supplied to the downstream roller 22 and the waveform of the voltage Vdev2 supplied to the upstream roller 24 include pulses rising in opposite directions. Here, the duty ratio of the pulses is lower than 50%. The waveform of the voltage Vdev1 for one period is asymmetric with respect to time, and the waveform of the voltage Vdev2 is also asymmetric with respect to time. The DC components Vdc (mean voltage) of the voltages Vdev1 and Vdev2 are substantially the same.

In the waveforms of the two voltages Vdev1 and Vdev2, in periods t21, in which the pulses rise in opposite directions, there is a potential difference that influences the movement of toner. In periods t20, which are the periods excluding the periods t21, there is a potential difference that only negligibly influences the movement of toner.

As a result, because the voltages Vdev1 and Vdev2 illustrated in FIG. 5 are supplied from the power supplies 291 and 292 to the downstream roller 22 and the upstream roller 24, the toner concentration of the developer distributed to the upstream roller 24 becomes higher than that of the developer distributed to the downstream roller 22.

Third Exemplary Embodiment

Next, a third exemplary embodiment of the present invention will be described. The elements the same as those of the exemplary embodiments described above will be denoted by the same numerals, and the difference between the third exemplary embodiment and the first and second exemplary embodiments will be described.

Figure 6:
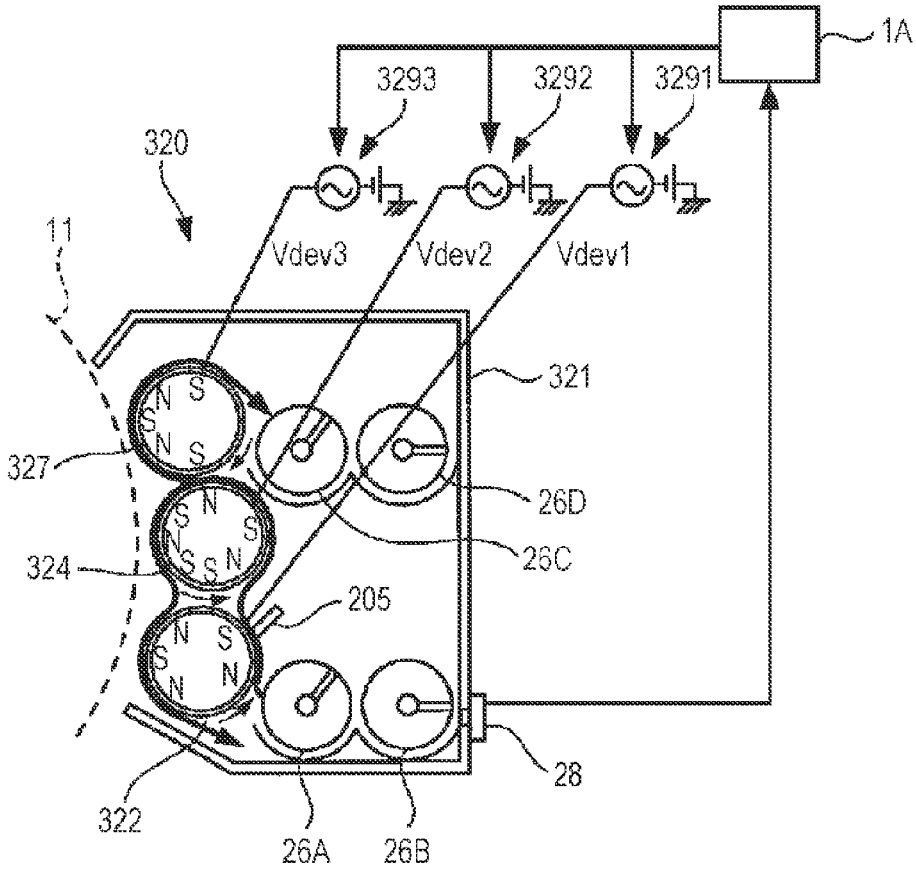
FIG. 6 is a schematic sectional view of a developing device according to a third exemplary embodiment.

FIG. 6 is a schematic sectional view of a developing device according to the third exemplary embodiment.

A developing device 320 illustrated in FIG. 6 includes three development rollers, which are a downstream roller 322, a center roller 324, and an upstream roller 327. A magnet is disposed in each of the development rollers 322, 324, and 327. In FIG. 6, the poles of the magnets are denoted by "N" and "S". Three power supplies 3291, 3292, and 3293 supply voltages to the three development rollers 322, 324, and 327. Because the developing device 320 includes three development rollers, the developing device 320 has development ability higher than that of the developing device according to the first exemplary embodiment. The developing device 320 includes four agitation members 26A to 26D.

Parts of the peripheral surfaces of the downstream roller 322 and the center roller 324 facing parts of the peripheral surface of the photoconductor drum 11 move in a direction substantially the same as the direction in which the parts of the peripheral surface of the photoconductor drum 11 move ("with"). In contrast, a part of the peripheral surface of the upstream roller 327 facing a part of the photoconductor drum 11 moves in a direction opposite to the direction in which the part of the peripheral surface of the photoconductor drum 11 moves ("against"). The upstream roller 327 has the highest development ability among the three development rollers 322, 324, and 327. The downstream roller 322 and the center roller 324 serve to reduce toner fog of an image. The downstream roller 322, which is disposed at the most downstream position, has a larger influence on the reduction of toner fog than the center roller 324 does.

In the developing device 320, the developer is supplied from the first agitation member 26A to the downstream roller 322. The layer regulation member 205 regulates the amount of the developer to be transported, and a part of the developer is distributed to the center roller 324. The developer that has been distributed to the center roller 324 moves while being supported on the peripheral surface of the center roller 324, and a part of the developer is distributed to the upstream roller 327. The developer that has been distributed to the upstream roller 327 passes through a region in which the upstream roller 327 and the photoconductor drum 11 face each other. The developer is transported to the agitation members 26C and 26D disposed at upper positions, and transported back to the agitation members 26A and 26B disposed at lower positions.

Figure 7:
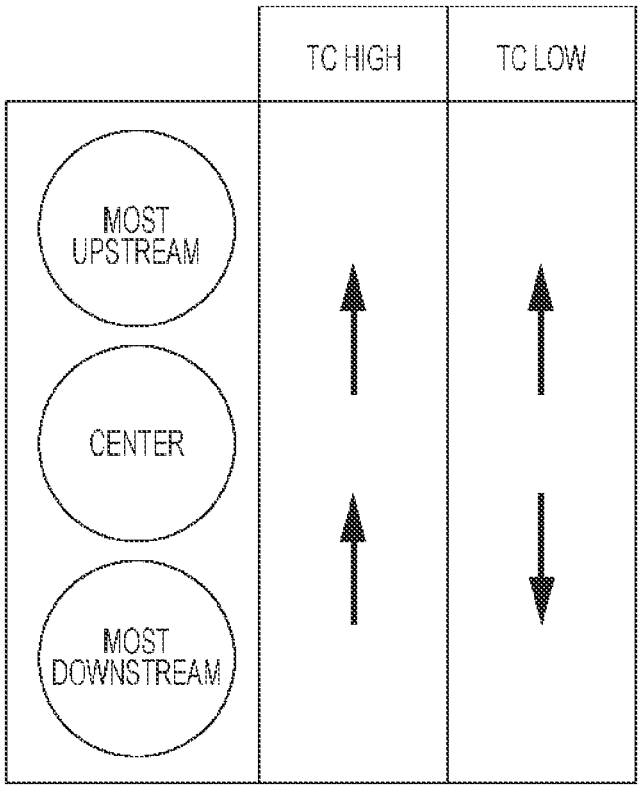
FIG. 7 is a chart illustrating the relationship between the toner concentration of a developer in a container and the trends of the toner concentrations of the developer supported on three development rollers.

FIG. 7 is a chart illustrating the relationship between the toner concentration of the developer in a container and control of the toner concentrations of the developer supplied to the three development rollers.

The developing device 320 according to the third exemplary embodiment includes the toner concentration sensor 28, which measures the toner concentration of the developer in a developer container 321. If the toner concentration measured by the toner concentration sensor 28 is higher than the upper limit of the standard range (TC high), toner fog is likely to occur in an image. In this case, the toner concentration of the developer supplied to the downstream roller 322, which is disposed at the most downstream position among the three development rollers 322, 324, and 327, is decreased by the largest amount, and thereby the occurrence of toner fog in an image is reduced. In this case, the toner concentration of the developer supplied to the center roller 324 is made higher than the toner concentration supplied to the downstream roller 322. The toner concentration of the developer supplied to the upstream roller 327 is made higher than the toner concentration supplied to the center roller 324.

In contrast, if the toner concentration measured by the toner concentration sensor 28 is lower than the lower limit of the standard range (TC low), a thin spot or a thin region is likely to be formed in an image. In this case, the toner concentration of the developer supplied to the upstream roller 327, which has the highest development ability among the three development rollers 322, 324, and 327, is made higher than the developer supplied to the center roller 324. Moreover, the toner concentration of the developer supplied to the downstream roller 322, which is disposed at the most downstream position, is made higher than the developer supplied to the center roller 324. Thus, the toner concentration of the developer supplied to the downstream roller 322, which is disposed at the most downstream position, is prevented from becoming excessively low.

Figure 8A:
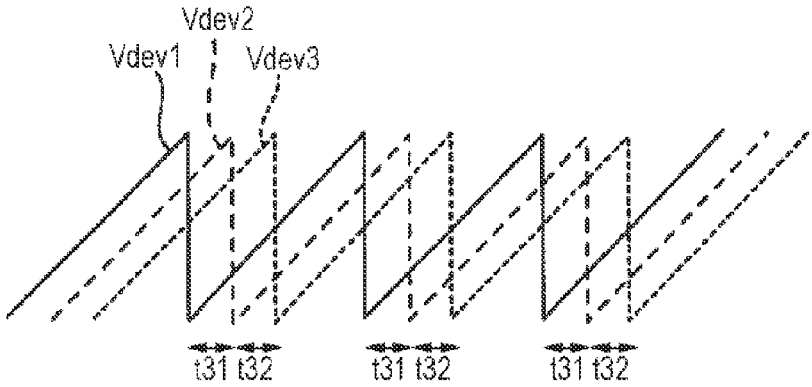
FIGS. 8A and 8B are diagrams illustrating the waveforms of voltages according to the third exemplary embodiment.
Figure 8B:
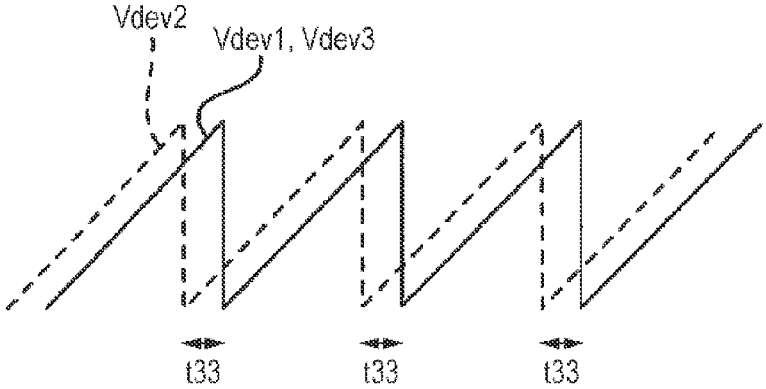

FIGS. 8A and 8B are diagrams illustrating the waveforms of voltages according to a third exemplary embodiment. FIG. 8A illustrates the waveforms of voltages supplied in the case of "TC high" in FIG. 7, and FIG. 8B illustrates the waveforms of voltages supplied in the case of "TC low" in FIG. 7.

In FIGS. 8A and 8B, the voltage Vdev1 is a voltage supplied to the downstream roller 322 from the power supply 3291. The voltage Vdev2 is a voltage supplied to the center roller 324 from the power supply 3292, and the voltage Vdev3 is a voltage supplied to the upstream roller 327 from a power supply 3293.

In each of the three voltages Vdev1, Vdev2, and Vdev3 illustrated in FIG. 8A, an AC voltage is superposed on a DC voltage. The AC components of the three voltages Vdev1, Vdev2, and Vdev3 are sawtooth waves having amplitudes and frequencies that are respectively the same as each other. The phases of the AC components are displaced from each other. As a result of the phase displacement, there are periods t31 in which the voltage Vdev2 of the center roller 324 is higher than (has a negative value whose absolute value is smaller than) the voltage Vdev1 of the downstream roller 322. Moreover, there are periods t32 in which the voltage Vdev3 of the upstream roller 327 is higher than the voltage Vdev2 of the center roller 324.

Due to the presence of the periods t31, the toner concentration of the developer distributed to the center roller 324 becomes higher than that of the developer distributed to the downstream roller 322. Due to the presence of the periods t32, the toner concentration of the developer distributed to the upstream roller 327 becomes higher than that of the developer distributed to the center roller 324. As a result, the toner concentration of the developer supported on the downstream roller 322 becomes the lowest.

The phases of the voltages Vdev1 and Vdev3 illustrated in FIG. 8B are the same as each other and are displaced from the phase of the voltage Vdev2. As a result of the phase displacement, there are periods t33 in which the voltage Vdev1 of the downstream roller 322 and the voltage Vdev2 of the center roller 324 are both higher than the voltage Vdev2 of the center roller 324. In the periods t33, the toner concentrations of the developer distributed to the upstream roller 327 and the downstream roller 322 become higher than that of the developer distributed to the center roller 324.

Figure 9:
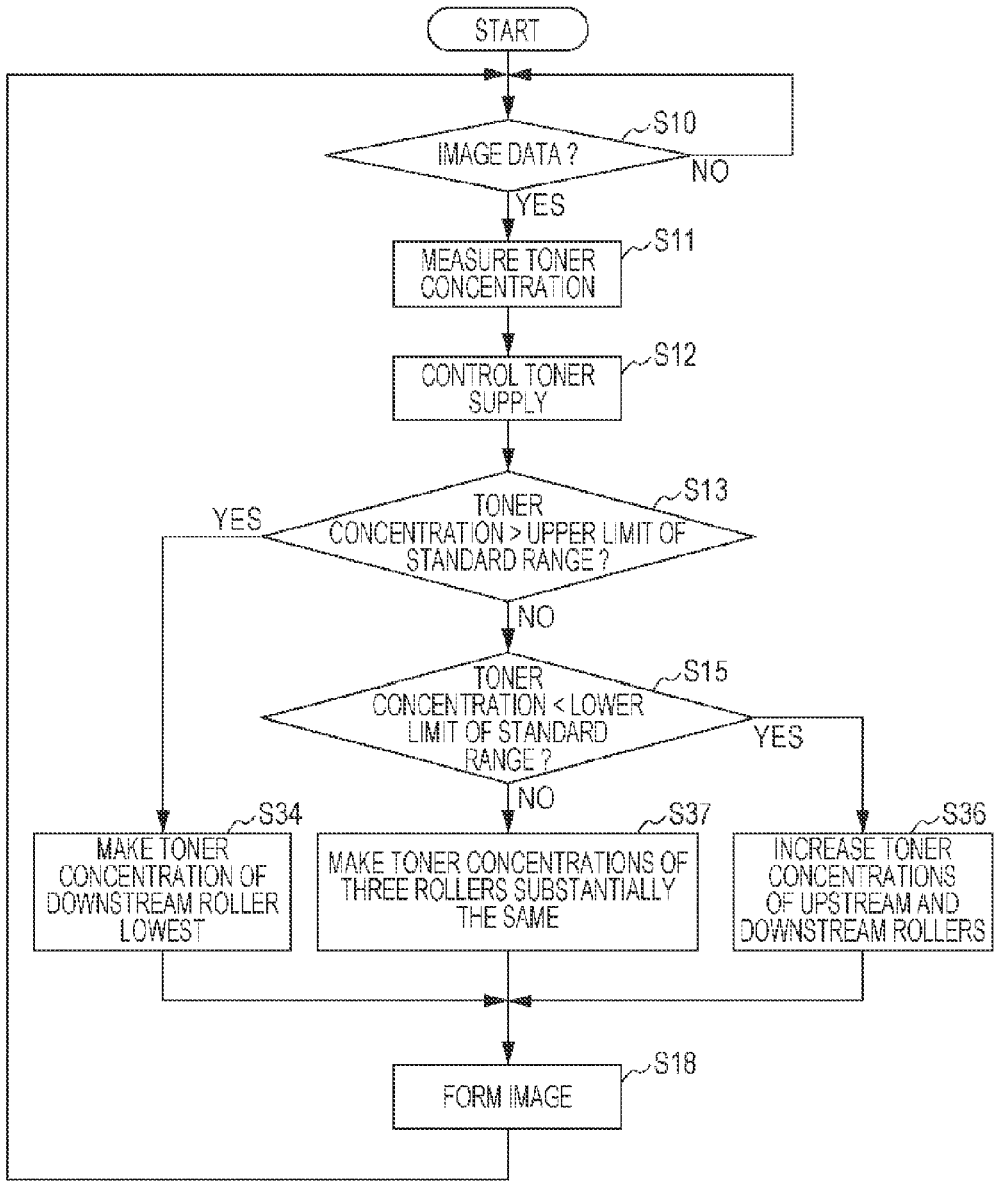
FIG. 9 is flowchart of an operation of an image forming apparatus according to the third exemplary embodiment.

FIG. 9 is flowchart of an operation of an image forming apparatus according to the third exemplary embodiment.

The operation according to the third exemplary embodiment differs from that of the first exemplary embodiment illustrated in FIG. 4 in step S34, step S36, and step S37.

Step S34 in FIG. 9 is performed if the measured toner concentration is higher than the upper limit of the predetermined standard range ("Yes" in step S13). In step S34, the toner concentration of the developer distributed to the downstream roller 322 is made the lowest. To be specific, the controller 1A illustrated in FIG. 6 causes the three power supplies 3291, 3292, and 3293 to respectively supply the voltages Vdev1, Vdev2, and Vdev3 having the waveforms illustrated in FIG. 8A. In this case, occurrence of toner fog due to excessively high toner concentration is reduced.

Step S36 is performed if the measured toner concentration is lower than the lower limit of the predetermined standard range ("Yes" in step S15). In step S36, the toner concentrations of the developer distributed to the upstream roller 327 and the downstream roller 322 are made higher than the developer distributed to the center roller 324. To be specific, the controller 1A illustrated in FIG. 6 causes the three power supplies 3291, 3292, and 3293 to supply the voltages Vdev1, Vdev2, and Vdev3 having the waveforms illustrated in FIG. 8B. In this case, generation of a thin spot and decrease in the density of an image are reduced.

Step S37 is performed if the measured toner concentration is within the standard range ("No" in step S15). In step S37, the toner concentrations of the developer distributed to the upstream roller 327, the center roller 324, and the downstream roller 322 are made substantially the same. To be specific, the controller 1A illustrated in FIG. 6 causes the three power supplies 3291, 3292, and 3293 to supply the voltages Vdev1, Vdev2, and Vdev3 having substantially the same phase.

Fourth Exemplary Embodiment

Next, a fourth exemplary embodiment of the present invention will be described. In the fourth exemplary embodiment, the waveforms of voltages supplied to the upstream roller 327, the center roller 324, and the downstream roller 322 are rectangular wave, instead of the sawtooth waves. The difference between the fourth exemplary embodiment and the third exemplary embodiment will be described.

Figure 10A:
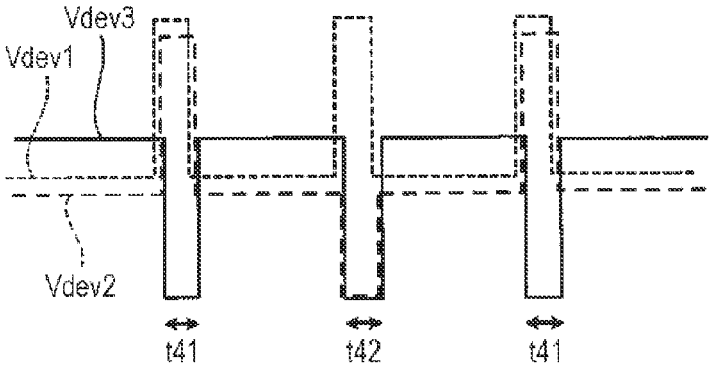
FIGS. 10A and 10B are diagrams illustrating the waveforms of voltages supplied to the downstream roller, the center roller, and the upstream roller according to a fourth exemplary embodiment.
Figure 10B:
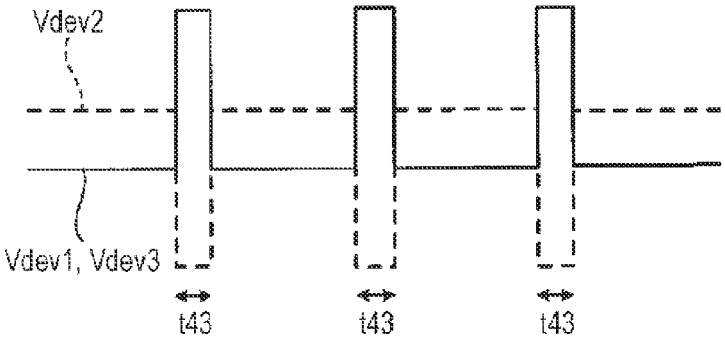

FIGS. 10A and 10B are diagrams illustrating the waveforms of voltages supplied to the downstream roller, the center roller, and the upstream roller according to a fourth exemplary embodiment. FIG. 10A illustrates the waveforms of voltages supplied when in the case of "TC high" in FIG. 7, and FIG. 10B illustrates the waveforms of voltages supplied when in the case of "TC low" in FIG. 7.

As illustrated in FIG. 10A, the waveform of the voltage Vdev1 supplied to the downstream roller 322 and the waveform of the voltage Vdev3 supplied to the upstream roller 327 include pulses rising in opposite directions. The waveform of the voltage Vdev2 supplied to the center roller 324 includes positive pulses and negative pulses that alternately occur. That is, the pulses of the waveform of the voltage Vdev2 rise in a direction opposite to that of the pulses of the waveforms of the voltage Vdev1 and the voltage Vdev3.

In periods t41, in which the pulses of the waveforms of the two voltages Vdev2 and Vdev3 rise in opposite directions, there is a potential difference that influences the movement of toner. As a result, the toner concentration of the developer distributed to the upstream roller 327 becomes higher than that of the developer distributed to the center roller 324. In periods t42, in which the pulses of the waveforms of the two voltages Vdev2 and Vdev1 rise in opposite directions, there is a potential difference that influences the movement of toner. As a result, the toner concentration of the developer distributed to the center roller 324 becomes higher than that of the developer distributed to the downstream roller 322. Therefore, the toner concentration of the developer distributed to the downstream roller 322 is decreased by the largest amount.

FIG. 10B illustrates the waveforms of the two voltages Vdev1 and Vdev3, which are the same as each other, and the waveform of the voltage Vdev2. In these waveforms, in periods t43, in which the pulses rise in opposite directions, there is a potential difference that influences the movement of toner. As a result, the toner concentration of the developer distributed to the upstream roller 327 becomes higher than that of the developer distributed to the center roller 324. The toner concentration of the developer distributed to the downstream roller 322 becomes higher than that of the developer distributed to the center roller 324.

In the exemplary embodiments described above, a sawtooth wave and a pulse wave are used as examples of a voltage waveform. However, the present invention is not limited to the exemplary embodiments, and the waveform may include, for example, curves having different rise and fall angles.

In the exemplary embodiments described above, the detector is the toner concentration sensor 28, which detects the toner concentration in the container 21. However, the present invention is not limited to the exemplary embodiments, and the detector may be a sensor that detects, for example, the toner concentration from the density of a reference image (batch image).

In the exemplary embodiments described above, two or three development rollers are used as examples of plural developer transport members. However, the present invention is not limited to the exemplary embodiments, and the number of the development rollers may be, for example, four or more.

In the exemplary embodiments described above, a tandem-type color printer is used as an example of an image forming apparatus. However, an image forming apparatus is not limited to this, and may be, for example, a monochrome printer that does not include an intermediate transfer belt.

In the exemplary embodiments described above, a photoconductor is used as an example of a latent image carrier. However, a latent image carrier is not limited to a photoconductor, and may be, for example, an object to which a voltage is directly applied by through an electrode.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image carrier that rotates and that has a surface on which an electrostatic latent image to be developed by a charged toner is formed;

a container that contains a developer including the toner;

a plurality of developer transport members disposed side by side so that peripheral surfaces thereof face the latent image carrier and so that the peripheral surfaces of adjacent ones thereof face each other, the developer transport members distributing the developer supplied from the container among one another and transporting the developer to the surface of the latent image carrier by carrying the developer on the peripheral surfaces and rotating in circumferential directions of the peripheral surfaces;

a power supply that supplies voltages having a plurality of waveforms having an identical period to the plurality of developer transport members;

a detector that detects a toner concentration of the developer contained in the container; and a controller that performs control so that the power supply supplies to the plurality of developer transport members, when the toner concentration detected by the detector is higher than a predetermined upper limit, voltages having the waveforms that generate a potential difference therebetween, the potential difference causing the toner concentration of the developer distributed to a most downstream developer transport member to decrease and the toner concentration of the developer distributed to at least one of the developer transport members that is disposed upstream of the most downstream developer transport member to increase, the most downstream developer transport member being one of the developer transport members that is disposed at a most downstream position in a movement direction in which a region on the surface of the latent image carrier facing the plurality of developer transport members moves.

2. The image forming apparatus according to claim 1, wherein the most downstream developer transport member rotates so that a region on the peripheral surface thereof and a region on the surface of the latent image carrier facing the region on the peripheral surface move in substantially the same direction, wherein a most upstream developer transport member, which is one of the plurality of developer transport members that is disposed at a most upstream position in the movement direction, rotates so that a region on the peripheral surface thereof and a region on the surface of the latent image carrier facing the region on the peripheral surface move in substantially opposite directions, and wherein the controller performs control so that the power supply supplies to the plurality of developer transport members, when the toner concentration detected by the detector is lower than a predetermined lower limit, voltages having the waveforms that generate a potential difference therebetween, the potential difference causing the toner concentration of the developer distributed to the most upstream developer transport member to increase and the toner concentration of the developer distributed to at least one of the developer transport members that is disposed downstream of the most upstream developer transport member to decrease.

3. The image forming apparatus according to claim 1, wherein the power supply supplies to the plurality of developer transport members, as the voltages having the plurality of waveforms, voltages having a plurality of waveforms including a common waveform and waveforms having phases that are displaced from each other so that there are phase periods in which a potential difference that influences movement of the toner.

4. The image forming apparatus according to claim 2, wherein the power supply supplies to the plurality of developer transport members, as the voltages having the plurality of waveforms, voltages having a plurality of waveforms including a common waveform and waveforms having phases that are displaced from each other so that there are phase periods in which a potential difference that influences movement of the toner.

5. The image forming apparatus according to claim 1, wherein the power supply supplies to the plurality of developer transport members, as the voltages having the plurality of waveforms, voltages having a plurality of waveforms including pulses that rise in opposite directions so that there are phase periods in which a potential difference that influences movement of the toner.

6. The image forming apparatus according to claim 2, wherein the power supply supplies to the plurality of developer transport members, as the voltages having the plurality of waveforms, voltages having a plurality of waveforms including pulses that rise in opposite directions so that there are phase periods in which a potential difference that influences movement of the toner.

* * * * *